United States Patent [19]

Ehlert et al.

[11] Patent Number: 4,633,934

[45] Date of Patent: Jan. 6, 1987

[54] HORIZONTAL CONTINUOUS CASTING METHOD

[75] Inventors: Klaus-Peter Ehlert, Moers; Achim Kubon, Neukirchen; Peter Voss-Spilker, Kempen, all of Fed. Rep. of Germany

[73] Assignee: Mannesmann Aktiengesellschaft, Duesseldorf, Fed. Rep. of Germany

[21] Appl. No.: 749,555

[22] Filed: Jun. 27, 1985

[30] Foreign Application Priority Data

Jul. 16, 1984 [DE] Fed. Rep. of Germany ..... 3426169

[51] Int. Cl.[4] ..... B22D 11/128

[52] U.S. Cl. ..... 164/484; 164/490

[58] Field of Search ..... 164/456, 484, 490, 478

[56] References Cited

U.S. PATENT DOCUMENTS

| | | | |
|---|---|---|---|
| 3,669,176 | 6/1972 | Krall | 164/484 |
| 3,730,251 | 5/1973 | Webbere | 164/490 |
| 3,817,313 | 6/1974 | Gamble | 164/484 |
| 4,437,509 | 3/1984 | Ahrens | 164/454 |
| 4,450,894 | 5/1984 | Taguchi | 164/484 |

FOREIGN PATENT DOCUMENTS

| | | | |
|---|---|---|---|
| 56-11143 | 2/1981 | Japan | 164/484 |

*Primary Examiner*—Nicholas P. Godici
*Assistant Examiner*—G. M. Reid
*Attorney, Agent, or Firm*—Ralf H. Siegemund

[57] ABSTRACT

A method of horizontal continuous casting of thin and wide ingots. The method includes providing a withdrawal or extraction length of 50 to 300 mm at a speed in excess of 3 meters per second up to 20 meters per second and holding the ingot for 1 to 5 seconds. Further, the ingot can be retracted to correspond to the length reduction due to cooling. The effect of the invention is an improvement in ingot quality.

2 Claims, 3 Drawing Figures

V
(mm/s)
b
a
t(s)

s
(mm)
b
a
t(s)

HORIZONTAL CONTINUOUS CASTING METHOD

BACKGROUND OF THE INVENTION

The present invention relates to the horizontal casting of metal, particularly steel, wherein the casting product is preferably a thin and wide ingot. Moreover the invention relates particularly to the horizontal casting of flat ingots and castings, wherein the liquid metal is discharged from a storage vessel into a mold provided for continuous casting in the horizontal direction. The flow from the storage vessel into the mold is an intermittent one and the casting is intermittantly extracted from the mold with holding times or pauses interposed. The term "thin and wide" in describing the casting or ingot is to be understood to mean a flat casting in which a cross section is of rectangular configuration, and the long side corresponding to the width of the casting having at least twice the thickness or height of the ingot.

Method and equipment for carrying out the aforementioned process is known generally, whereby from a practical point of view a 30 mm extraction path may be used for one extraction step followed by a retraction of maximum 1 mm; a hold down or delay time of 1 second is interposed between casting steps with an average casting speed of 2 m per minute. The cross section is to be the equivalent of a circle of about 150 mm diameter. In case of a current casting the speed is somewhat higher.

The mold contours are to be matched to the rather complex process which the casting itself undergoes including here quenching, reheating, cooling and the like. A change in the stroke length as far as the withdrawing is concerned, requires unfortunately a new and different mold contour and could in cases approach in principle an unlubricated mold for vertical casting. In such a case however, one would encounter the known drawbacks of a rather uncontrolled skin formation for withdrawal speeds of less than 5 meters per minute. Morever such a product exhibits rather poor surface quality and is almost unusable. For very thin and wide castings, socalled thin slabs, one may encounter up to 100% waste. Moreover, in view of these dimensions, the skin could be weakened to a considerable extent, so that a rupture and skin perforation may occur quite frequently. The known process moreover is simply not useable for high production rates and casting speeds.

In order to improve the situation here one has to change and modify i.e. increase the withdrawal speed and withdrawal length. Possibly the holding period should be reduced.

For known reasons the mold cannot be lubricated in the horizontal casting process, so that the power or throughput of such process can only approximate to some extent but never reach the productivity level of a vertical or curved casting operation.

DESCRIPTION OF THE INVENTION

It is an object of the present invention to improve continuous casting of thin and wide castings with the principle objective being an increase in throughput.

In accordance with the preferred embodiment of the present invention it is suggested to provide a casting at withdrawal or extraction length from 50 to 300 mm or more per withdrawal step at a withdrawal speed in excess of 3 meters per minute up to 20 meters per minute and the casting in between two extraction steps is to be held from 1 to 5 seconds. It was found that no stroke markers, cracks or other alloy components segregation or the like occurs as is known to occur in the known procedure. The invention therefore is a particularly favorable tuning of several factors such as withdrawal length per extraction step, casting speed and holding time.

In furtherance of the invention it is suggested to retract the casting corresponding to the length reduction on account of cooling, in between two extraction steps. Such retraction compensates for this reduction in length.

In furtherance of the invention it is suggested to extract the casting at a low rate of acceleration. Owing to a suitable adjusting of the flow speed to achieve a laminar flow one obtains in effect concatenated skin curls which however are compensated through followup flow at the separation ring so as to obtain practically a uniformly strong skin, being uniform in thickness over the entire length of withdrawing in one step. The curls are in fact remelted so that the skin will obtain a uniform configuration. The solidification texture moreover is more favorable in this case.

Another advantageous feature is to be seen in that the skin part seated at the separation ring will grow somewhat stronger owing to the long delay and holding period but is remelted on contact with hot molten metal during drawing owing to the flow of fresh metal into the liquiduous core. This effect leads to low depth of the stroke markers and again facilitates the formation of a uniform skin. The mold should be configured that its length is not smaller than twice the extraction step length.

DESCRIPTION OF THE DRAWINGS

While the specification concludes with claims particularly pointing out and distincly claiming the subject matter which is regarded as the invention, it is believed that the invention, the objects and features of the invention, and further objects, features and advantages thereof will be better understood from the fllowing description taken in connection with the accompanying drawings in which:

Proceeding now to the detailed description of the drawings, FIG. 1 illustrates a casting nozzle 7 which pertains to a storage vessel which is not illustrated but 7 can be considered a part of that vessel, the vessel proper extends to the left of the drawing. A separating ring 6 is provided for separating the nozzle 7 from the mold for continuous casting 5. The separator 6 is sealed to both the nozzle element 7 and the tubular mold 5.

Figure 1:
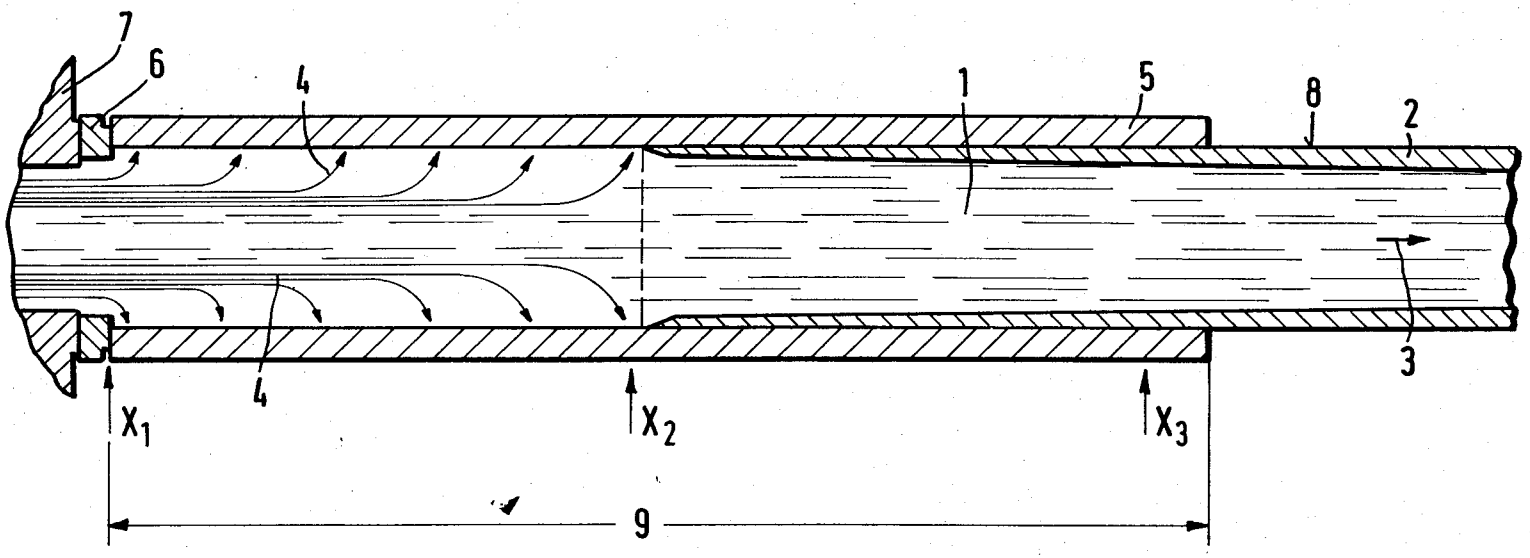
FIG. 1 illustrates a longitudinal cross section through a nozzle of a container and vessel with separating ring and water cooled horizontal casting mold.

The start-up procedure is not illustrated. Conventionally metal that flows into the mold through the nozzle 7 assumes a flow pattern, such as 4 and is therefore distributed in the mold 5. X2 and X3 each denote the end of an extraction and withdrawal length, and at the end, i.e. at the level X2 the molten metal 1 is, at least on the surface, cooled down to the solidification temperature so that a skin 2 is formed as the casting is withdrawn in the direction 3. During the next extraction step therefore one will extract the length X2 measured from to X3. The casting 8 is expected to shrink in thickness and length during the extraction. The total length 9 of the mold is therefore the sum of the 2 extraction lengths (X1−X2)+(X2−X3).

The feeding of molten metal under exclusion of air is not a complicated aspect of practicing the invention and does influence the fact that such as construction feature expenditure in a positive way.

Figure 2:
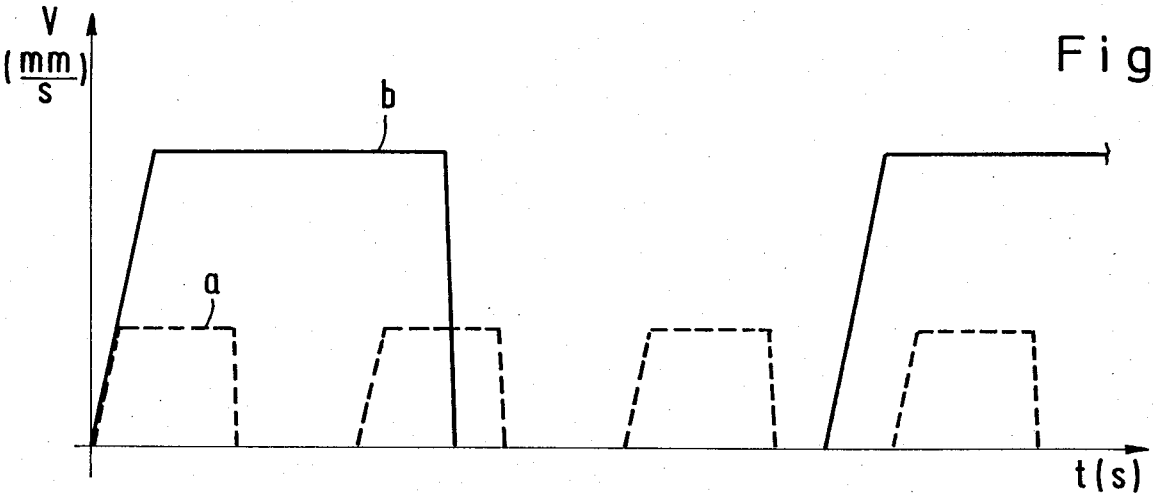
FIG. 2 is a speed time diagram comparing conventional horizontal continuous casting with the inventive one.

In accordance with conventional horizontal casting really flat products are practically not attainable because the frequency of the extraction as depicted by the diagram portions a in FIG. 2 is so high and the extraction speed is correspondingly so low and the extraction steps are so short so are the holding periods that the surface of the product is inadequate. These surface deficiencies are avoided if as per the invention when casting proceeds as per diagram b in FIG. 2. The acceleration remains the same as in the conventional method, but the speed levels are higher and the extraction length, and therefore extraction duration are longer. Moreover the holding periods in between extraction steps are larger. In combination these features establish a much improved surface quality of the product.

Figure 3:
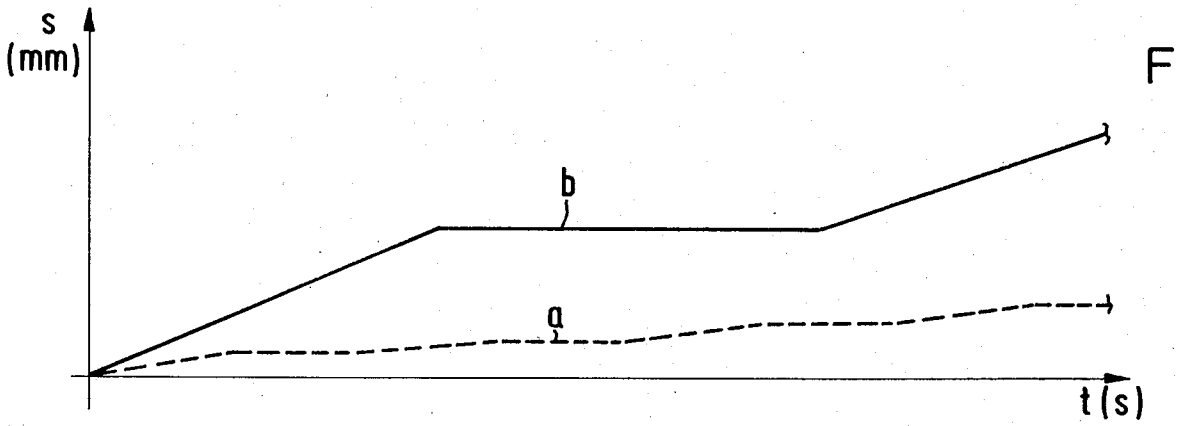
FIG. 3 is a time path diagram relating the extraction length attained with a different time and speed as per FIG. 2.

FIG. 3 can be interpreted as a composite or integral of the diagrams of FIG. 2. The extraction path lengths are shown for the two cases a and b. It can readily be seen that owing to a conventional small extraction speed the extraction lengths as per the prior art are shorter as per the known method diagram a. The longer waiting periods as per the inventive method by no means lower the overall extraction length to the level as per diagram a. The following table compares conventional horizontal casting with horizontal casing in accordance with the invention.

Conventionally one uses an extraction length of 28 mm a cycle time of: 54 cycles/min.

a holding period of: 0.5 sec.

at a casting speed of: 1,5 meters/min.

The novel extraction and horizontal casting operates at an extraction length of: 250 mm an extraction cycle of: 15 cycles/min.

a holding period of: 2,5 sec at a casting speed of: 3,7 meters/min.

The invention is not limited to the embodiments described above, but all changes and modifications thereof, not constituting departures from the spirit and scope of the invention are intended to be included

We claim:

1. Method of continuous casting of metal, particularly steel, to obtain thin and wide ingots under utilization of a casting vessel and a mold for continuous casting the mold being fed intermittently comprising the steps of:

providing a continuous casting mold capable of casting thin and wide ingots, wherein said thin and wide ingots have a width at least twice the thickness of the ingot, and the length of the mold is at least twice the length of an extraction length, extracting an ingot from said mold in repeating cyclic steps, wherein each of said cyclic steps includes:

(i) an extraction step which includes extracting the extraction length of said ingot at an extraction speed, wherein said extraction length exceeds 50 mm and said extraction speed is greater than 3 meters per minute but less than or equal to 20 meters per minute; and (ii) following said extraction step is a holding period, said holding period being equal to or greater than one second, but less than 5 seconds.

2. Method as in claim 1, wherein during the holding period a small retraction step is superimposed upon the casting to compensate length reductions on account of cooling.

* * * * *